US005391279A

United States Patent [19]

McLaughlin

[11] Patent Number: 5,391,279

[45] Date of Patent: * Feb. 21, 1995

[54] MOBILE ELECTROPLATING UNIT

[75] Inventor: Daniel A. McLaughlin, Madeira Breach, Fla.

[73] Assignee: Gold Effects, Inc., Largo, Fla.

[ * ] Notice: The portion of the term of this patent subsequent to Sep. 13, 2011 has been disclaimed.

[21] Appl. No.: 286,540

[22] Filed: Aug. 5, 1994

Related U.S. Application Data

[63] Continuation-in-part of Ser. No. 126,375, Sep. 24, 1993, Pat. No. 5,346,602.

[51] Int. Cl.[6] ..... C25D 17/14

[52] U.S. Cl. ..... 204/224 R; 204/271

[58] Field of Search ..... 204/224 R, 271

[56] References Cited

U.S. PATENT DOCUMENTS

| | | | |
|---|---|---|---|
| 3,752,752 | 8/1973 | Slatin et al. | 204/194 |
| 4,069,127 | 1/1979 | Salemi et al. | 204/271 X |
| 4,668,364 | 5/1987 | Farmer et al. | 204/224 R |
| 4,810,343 | 3/1989 | Bonnardel | 204/271 X |
| 5,244,558 | 9/1993 | Chiang | 204/271 X |
| 5,346,602 | 9/1994 | McLaughlin | 204/271 X |

*Primary Examiner*—Donald R. Valentine

*Attorney, Agent, or Firm*—James E. Larson

[57] ABSTRACT

A compact, hand portable, mobile electroplating unit provided with wheels, a seat for the user, and all of the chemical solutions and applicator equipment, including a D.C. power source, required to electroplate a metallic film on a metallic surface.

20 Claims, 11 Drawing Sheets

MOBILE ELECTROPLATING UNIT

This application is a continuation-in-part of application, Ser. No. 08/126,375, filed on Sept. 24, 1993, now U.S. Pat. No. 5,346,602.

BACKGROUND OF THE INVENTION

1. Field of the Invention

This invention relates to a compact, hand portable, mobile electroplating unit which incorporates all of the materials and equipment, including a D.C. power source, required for electroplating a metallic surface while the user is seated on the unit. In particular, this invention relates to such a unit for electroplating gold on selected metallic surfaces of vehicles.

2. Description of Prior Art

U.S. Pat. Nos. 3,752,752 and 4,668,364 disclose hand portable electroplating kits. The kit shown in each of the patents comprises an attache or brief case in which the equipment for performing an electroplating operation is housed. The brief case type arrangement of the patented kits requires that they be supported on a stable surface during use, and that an operator or user take a position in front of and facing the open case and the harmful, or even dangerous, metal treating chemicals contained in the lower compartment of the kit. Apart from the hazards inherent in the use of the kits, they lack the mobility and maneuverability called for in the in-place gold plating of emblems and other metal surfaces of a motor vehicle where frequent changing of positions and orientation with relation to a surface to be plated are necessary. The kits shown in the patents have the further disadvantage of requiring manual control by a user of voltage output for each plating operation, an in-exact procedure which can lead to an unsatisfactory or poor finished product. The kit shown in U.S. Pat. No. 4,668,364 has a unique disadvantage in that it utilizes a 24 carat gold anode to electroplate a gold film on a surface. Wholly apart from the prohibitive expense of employing an anode of that character in any plating operation, let alone in the gold plating of emblems and other metal surfaces of a vehicle, the expense of providing adequate security to prevent theft of the gold anode would militate against the use of the apparatus shown in the patent.

SUMMARY OF THE INVENTION

In accordance with the present invention, a lightweight, hand portable, easily maneuverable, mobile electroplating unit is provided which, while adaptable for use in any electroplating operation where portability and maneuverability are considerations, is especially suitable for use in electrolytically gold plating emblems, grills, and other metallic surfaces on vehicles. The unit is provided with wheels for ease of movement by a user to any desired position on the outside of a vehicle. In addition, the unit is provided with a seat to enable a user to assume a sitting position on the unit with his or her face and hands a safe distance from the plating solutions supported on the unit, and yet permitting ready and safe access to the solutions. A D.C. power source having a plurality of receptacles is provided on the unit which is unique in that the voltage and current output at each receptacle is automatically maintained at an optimum predetermined level thereby eliminating any power surges, and the need for any manual control of voltage output by the user. This feature of the D.C. power service employed with the unit has the further advantage of preventing shorts or arcs which would otherwise occur if a plating electrode accidentally came into contact with the surface of a workpiece during plating. The unit also is provided with a plurality of hand manipulated chemical solution applicators each of which is connectable by a wire lead to the D.C. power source through the voltage output receptacles of the power source. Each of the applicators carries an anode for applying a single chemical plating solution on a workpiece. Each of the anodes is detachable from its associated applicator for storage and transportability, and advantageously is provided with an absorbent sleeve or cover for ease in applying the chemical solutions, and, further, to prevent any accidental contact between the anode and the workpiece which may damage the surface of the workpiece as by scratching. A complete circuit between the D.C. power source and the workpiece is attained by a hand manipulated member which is connectable to the power source through a receptacle on the power source, and acts as a cathode or anode during the plating operation. In a preferred embodiment, the power source is removable from the unit thereby allowing greater flexibility of use of the unit, easy access to the power source for maintenance procedures, and greater ease in cleaning the unit. The removable power source can be positioned on any stable surface permitting electroplating procedures in a wide variety of locations. The unit has means which serves to maintain the applicators in a stable position over their associated chemical solution container when not in use, and acts to prevent the wire leads carried by the applicators from coming into contact with the solutions in the containers. The unit also incorporates storage means within reach of a user seated on the unit for holding plating solutions and other equipment useful for carrying out a plating operation.

The various features of novelty which characterize the invention are set forth with particularity in the claims annexed to and forming a part of the present disclosure. For a better understanding of the invention, its advantages, and the outstanding results attained through its use, reference is made to the accompanying drawings and descriptive matter in which a preferred embodiment of the invention is illustrated and described.

DETAILED DESCRIPTION OF THE INVENTION

Figure 1:
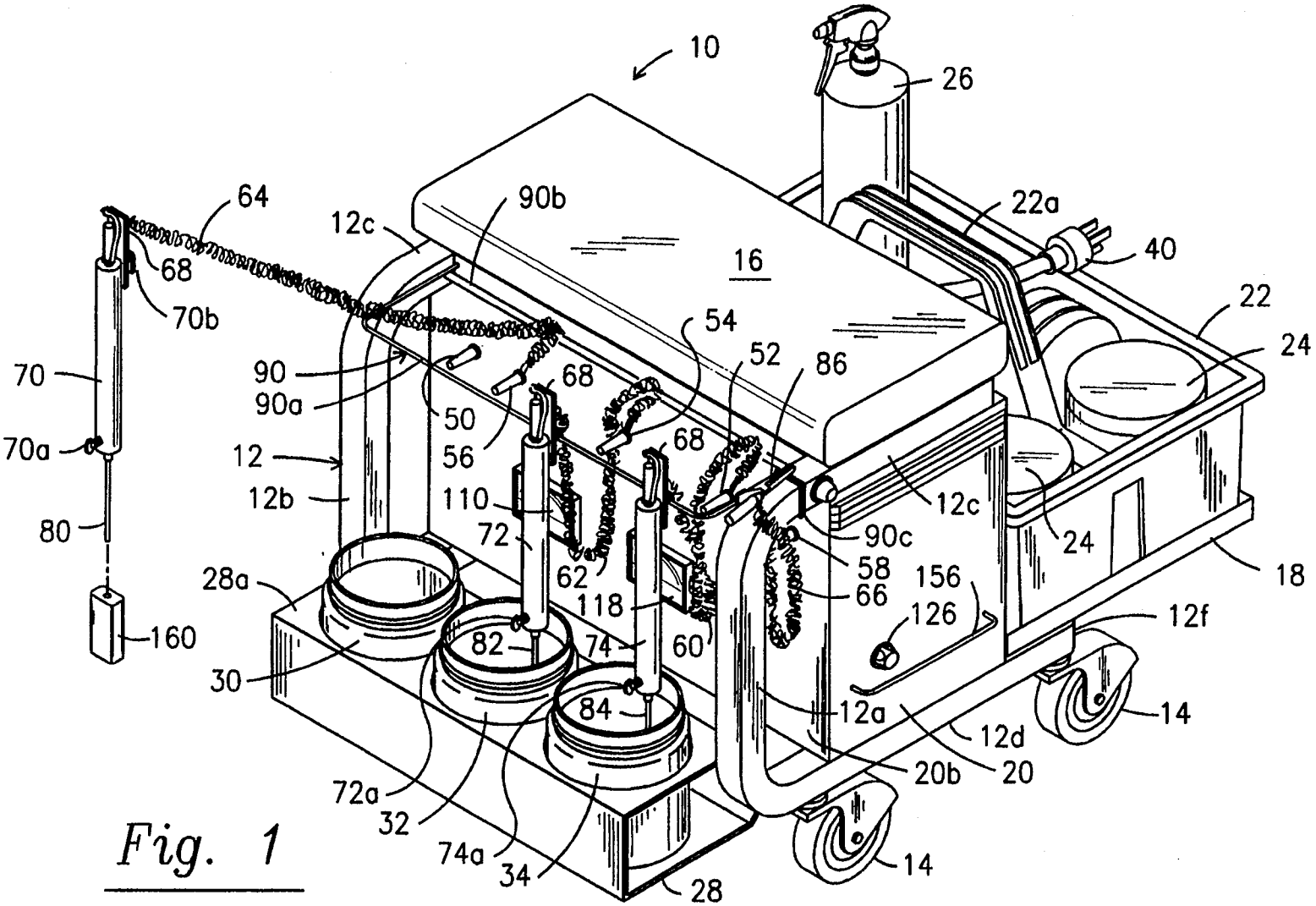
FIG. 1 is a view in perspective of an embodiment of the mobile electroplating unit of the present invention.

Referring, now, to the drawings, the embodiment of the electroplating unit of this invention illustrated, and designated generally by reference numeral 10, comprises a support member or frame 12 formed by a pair of spaced, generally C-shaped side portions 12*a* and 12*b* each having an upper, horizontal arm 12*c* and a lower horizontal arm 12*d*. The ends of the arms 12*c* and 12*d* are interconnected by an upper crossbar 12*e* and a lower crossbar 12*f*, respectively. The frame 12 desirably is fabricated of a lightweight metal.

The frame 12 has two pairs of casters or wheels 14 secured to the lower arms 12*d* thereof. The casters or wheels 14 advantageously are freely rotatable through a 360 degree angle to impart optimum maneuverability to the unit 10.

A bench-like seat 16 extends across the frame 12 and is secured to the upper arms 12*c* of the side portions 12*a* and 12*b* of the frame 12. The seat 16 is padded, and has an upper surface area wide enough and long enough to comfortably accommodate a user of the unit 10.

A storage bin 18 is provided for the unit 10, and is positioned at the rear of the frame 12 along the lower crossbar 12*f* of the frame 12. The bin 18 is held on the frame 12 by bolts (not shown) to enable it to be freed from the frame 12 when, for some reason, it is desired to remove the D.C. power source 20 from the unit 10. The bin 18 is adapted to receive a tote box 22. The tote box 22 is provided with a handle 22*a*, and has sufficient capacity to receive containers 24 for holding all of the required chemical plating solutions, and equipment, such as protective gloves (not shown) and goggles (also not shown). A spray bottle 26, for water, is also provided to rinse away residual chemical solution from the workpiece so that the next step in the plating operation can proceed.

The front of the frame 12 has a tray 28 secured thereon for holding chemical solution containers 30, 32 and 34. The containers 30, 32 and 34 are maintained in stable, spaced relation to one another by cut-outs formed in the top 28*a* of the tray 28. Lids (not shown) are provided for each of the containers when the unit 10 is not in use or is being transported.

In the embodiment of the unit 10 illustrated in FIGS. 1–8, the D.C. power source 20 is carried on the lower arms 12*d* of the frame 12 between the bin 18 and the tray 28, and below the seat 16. Extending outwardly from the rear wall 20*a* of the D.C. power source 20 is a three lead electrical cord 40 for connection to a 120 volt AC source, for example. The front wall 20*b* of the D.C. power source 20 is provided with five voltage output receptacles 42, 44, 46, 48, and 50 (see FIG. 4), wherein receptacles 44, 46, and 48 receive connectors 52, 54, and 56 respectively. Connectors 52, 54, and 56 are secured at one end to retractable coiled leads or cables 60, 62, and 64 respectively. Output receptacles 42 and 50 alternatively receive connector 58. A retractable coiled lead or cable 66 is secured to connector 58 at one end as shown in FIG. 1. The receptacles 42, 44, 46, 48, and 50 and the connectors 52, 54, 56, and 58, desirably are of the banana jack and plug, respectively, type to provide secure contact between the power source 20 and the cables 60, 62, 64, and 66.

As shown in FIG. 1, the other end of each of the cables 60, 62 and 64 is attached to a cable strain relief member 68 which is mounted on the end of hand manipulated applicators or wands 70, 72, and 74. The wands 70, 72, and 74 are in the shape of elongated metallic cylinders and each wand is desirably provided with a thumb screw 70*a*, 72*a*, and 74*a*, respectively. The thumb screws 70*a*, 72*a*, and 74*a* serve to releasably retain metallic anodes 80, 82, and 84 in position on the wands 70, 72, and 74, respectively.

Figure 2:
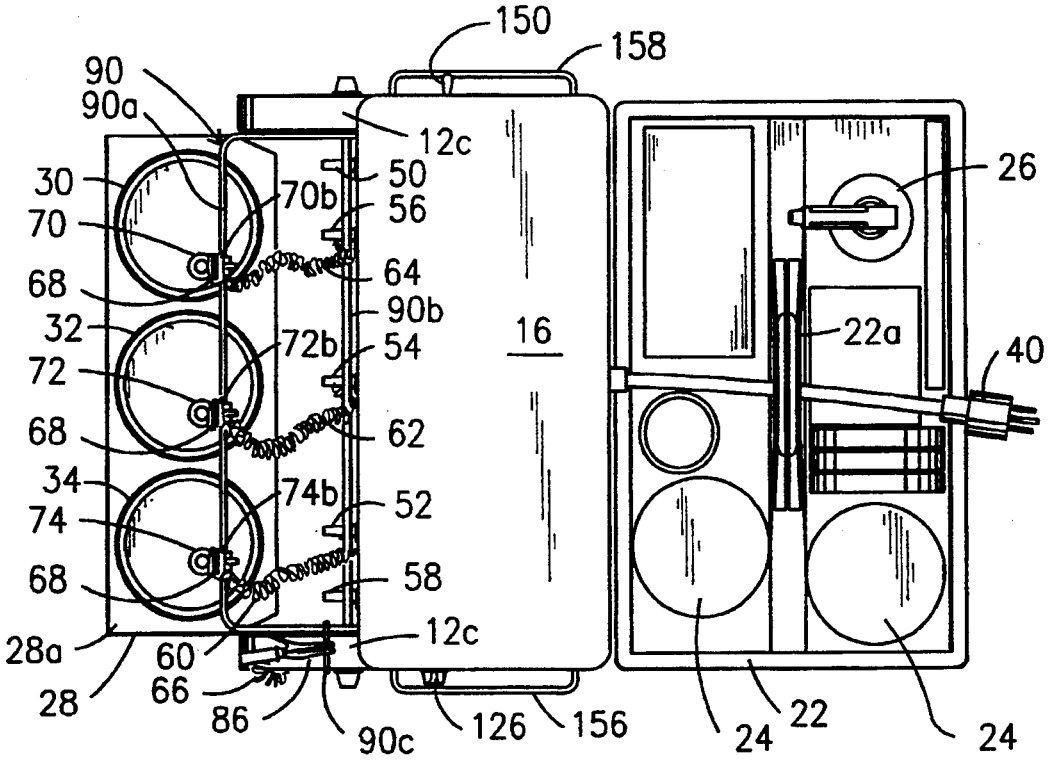
FIG. 2 is a top plan view of said embodiment.

The cable 66 can be connected through its connector or banana plug 58 to either output receptacle 42 or 50 of the D.C. power source 20, depending upon whether the user is left handed or right handed, and is provided at its other end with a workpiece contact member which may take the form of an alligator clip 86, as shown in FIGS. 1 and 2. The clip 86 acts as a cathode or anode during an electroplating operation, and serves to complete an electric circuit between the workpiece and the D.C. power source 20.

As best shown in FIGS. 1 and 2 of the drawings, a wand and cable supporting rack 90 is positioned at the front of the unit 10 at a level below that of the top of the seat 16. The rack 90 includes an outer rod member 90*a* for supporting the wands 70, 72, and 74 above each of their associated chemical solution containers 30, 32, and 34. Each of the wands 70, 72, and 74 advantageously has a hook or clip 70*b*, 72*b*, and 74*b*, respectively, secured to the upper end thereof, adjacent to the strain relief member 68, which releasably engages the rod member 90*a*, and maintains the wands in a fixed position thereon when awaiting use, or when not in use. The rack 90 also has an inner rod member 90*b* which enables a portion of each the cables 60, 62, and 64 to be looped thereover to provide a strain relief to prevent any possibility of the cables from being disconnected from the connectors or banana plugs 52, 54, and 56. An extension 90*c* is provided on the rack 90 for receiving the working end, or alligator clip 86, on the outer end of the cable 66.

Figure 4:
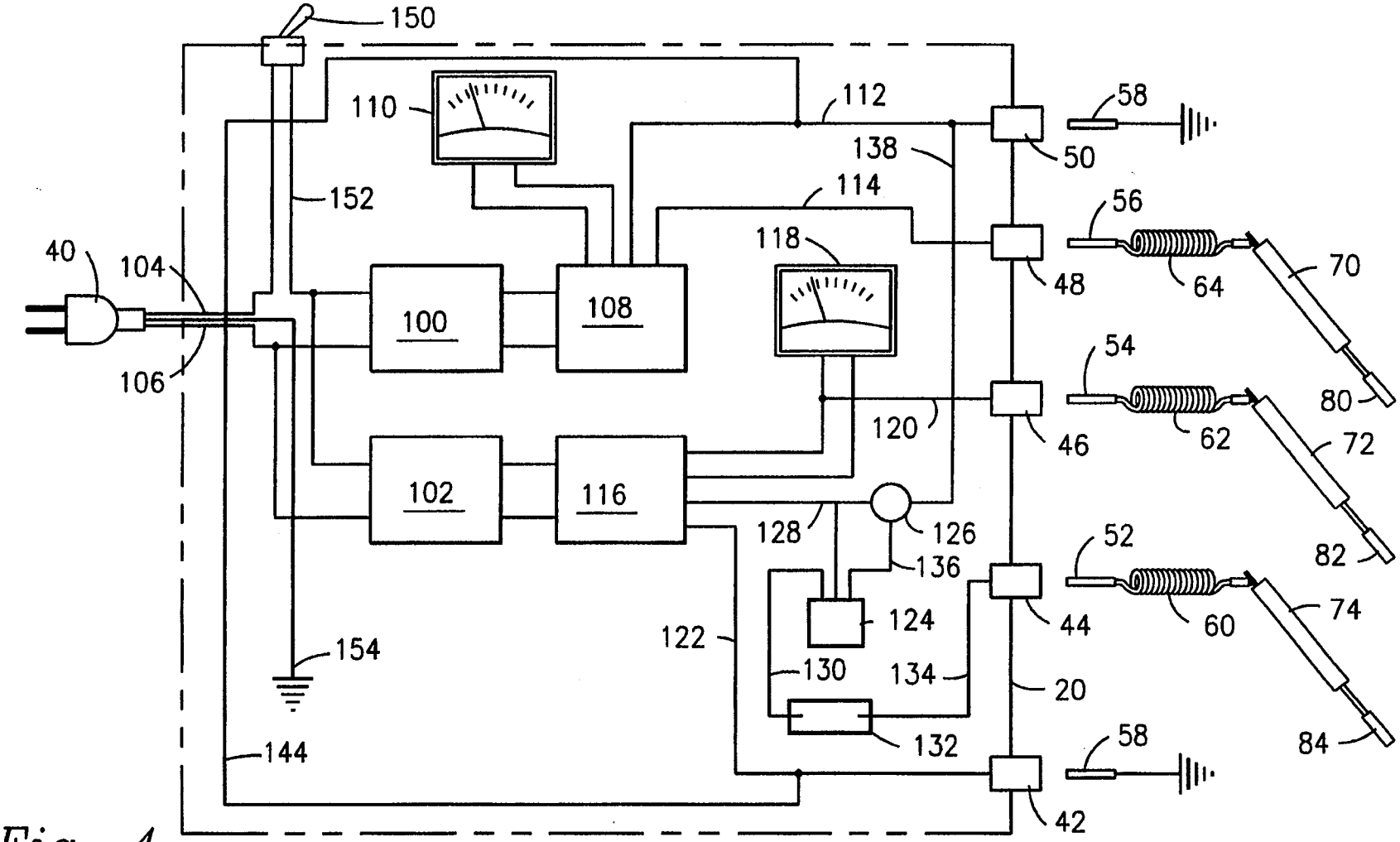
FIG. 4 is a schematic circuit diagram of a D.C. power source of the type incorporated in said embodiment of the invention.
Figure 5:
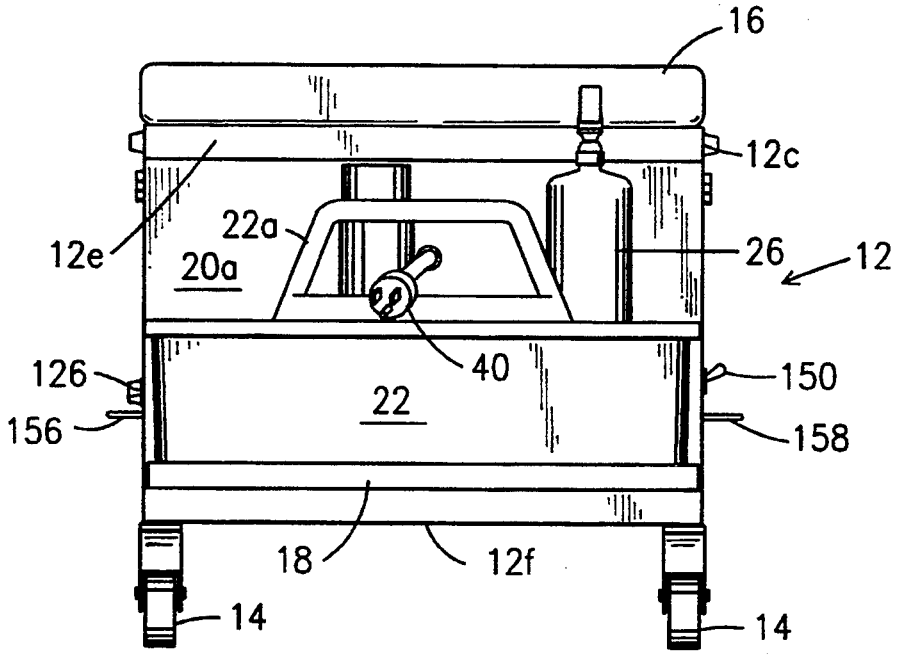
FIG. 5 is a rear view in elevation of said embodiment.
Figure 6:
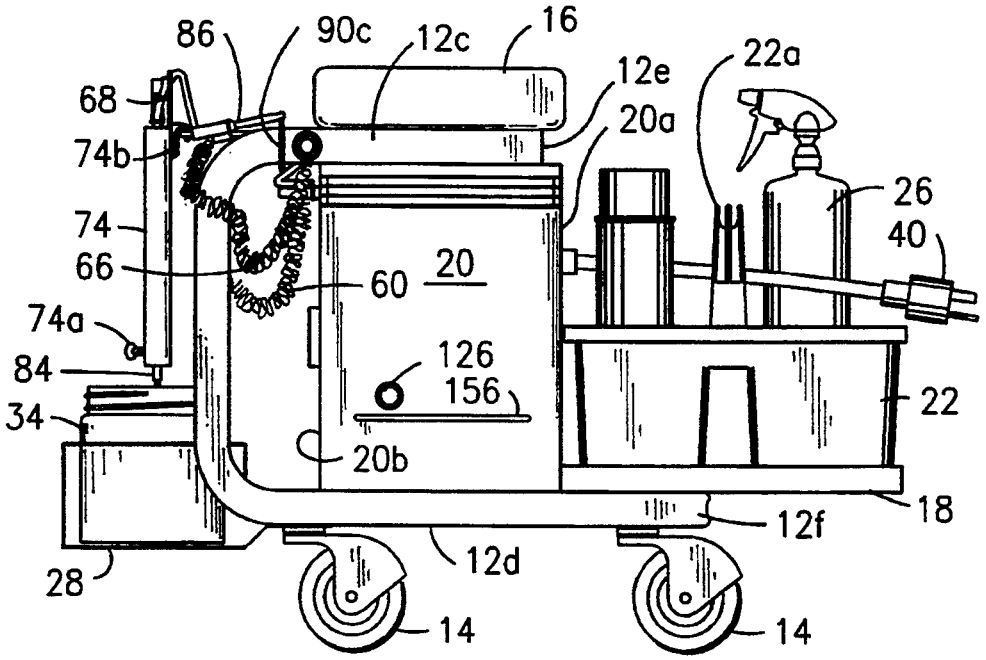
FIG. 6 is a left side view in elevation of said embodiment.
Figure 7:
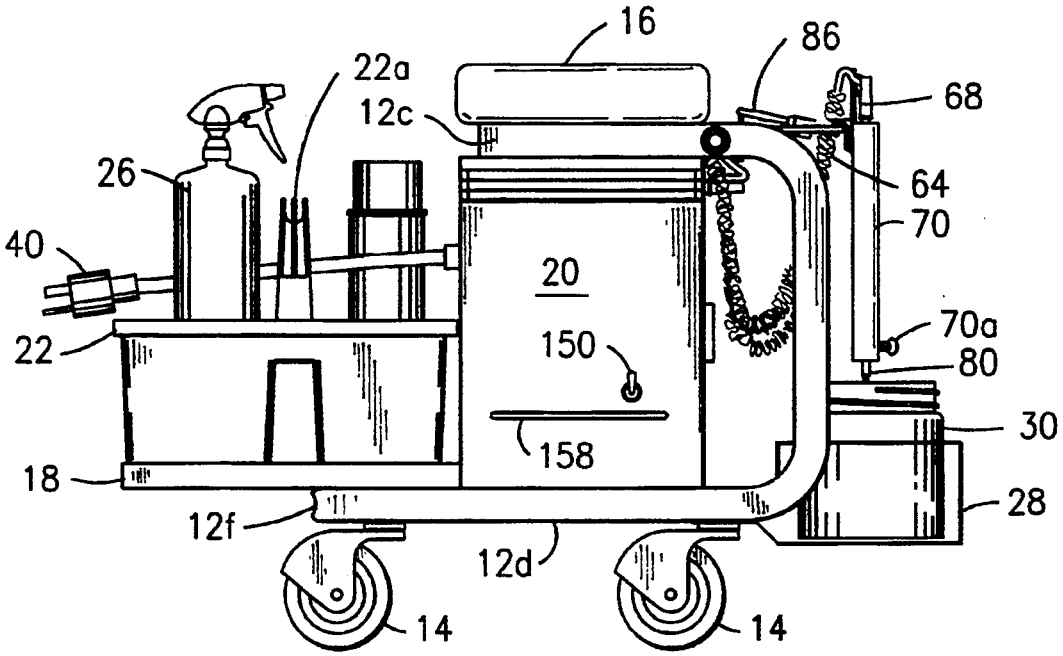
FIG. 7 is a right side view in elevation of said embodiment.
Figure 8:
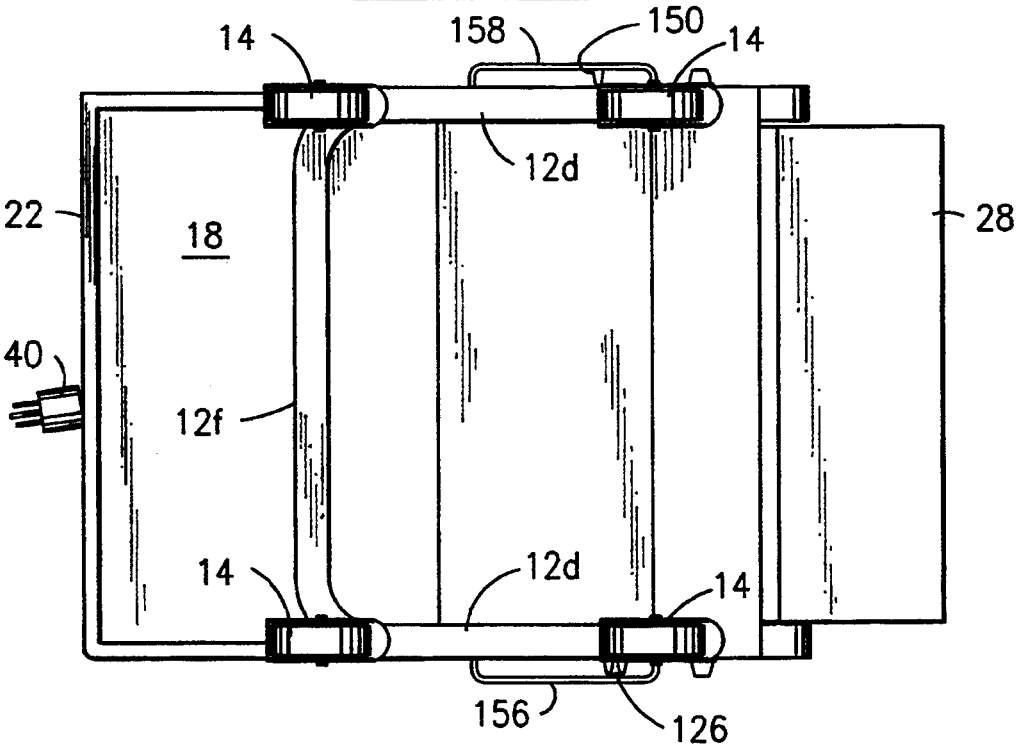
FIG. 8 is a bottom plan view of said embodiment.

Referring, now, in particular to FIG. 4 of the drawings, a pair of transformers 100 and 102 are connected to the electric cord 40 through leads 104 and 106, respectively. The transformer 100 is connected to a full wave rectifier 108 which is connected to a D.C. voltmeter 110, and to banana jack 48 and banana jack 50 through leads 112 and 114. The rectifier 108 also includes a filter and current regulating circuit. The transformer 102 is connected to a full wave rectifier 116, which, in turn, is connected to a D.C. voltmeter 118. The rectifier 116 is also connected through lead 120 to banana jack 46, and to banana jack 42 through lead 122. The rectifier 116, like the rectifier 108, includes a filter and current regulating circuit. The rectifier 116 is further connected to a transistor 124 and an intensity adjustment control knob 126 by lead 128. The transistor 124 is connected by lead 130 to resistor 132. The resistor 132 is connected to banana jack 44 by lead 134. The transistor 124 is connected by lead 136 to the intensity adjustment control knob 126. The control knob 126, in turn, is connected by lead 138 to banana jack 50 across the lead 112. Ground line 144 is connected across leads 112 and 122 to banana jacks 42 and 50. An on-off switch 150 is connected to an A.C. power source, for example, through lead 152. The cord 40 is grounded to the D.C. power source housing as shown at 154.

The transformers, rectifiers, transistors, and related electrical equipment are available commercially in preassembled form. Exemplary of such commercially available equipment are Models HB-1.7A+ and HD 12-6.8A+ sold by Condor Manufacturing Company located in Oxnard, Calif. The first mentioned model has a 1.7 ampere rating and is employed in the metal surface activator and gold plating operations performed by the unit 10. Model HD 12-6.8A+ has a 6.8 ampere rating and is employed in the metal stripping operation of the unit 10.

As stated above, the D.C. power source 20 has three voltage outlets, namely, receptacles or jacks 44, 46, and 48. Each of the wands 70, 72, and 74 is connected to its own voltage output source. The use of multiple voltage outputs, as opposed to a single output source, eliminates the need for the user to plug and unplug a single output lead for each wand before a step in the plating operation is performed. The voltage output for each wand is hard wired to the correct polarity and the voltage level needed to perform each step in the plating operation. Therefore, it is not necessary to provide a polarity switch or voltage adjustment for the unit 10 as in the case of the patented devices discussed initially.

Figure 3:
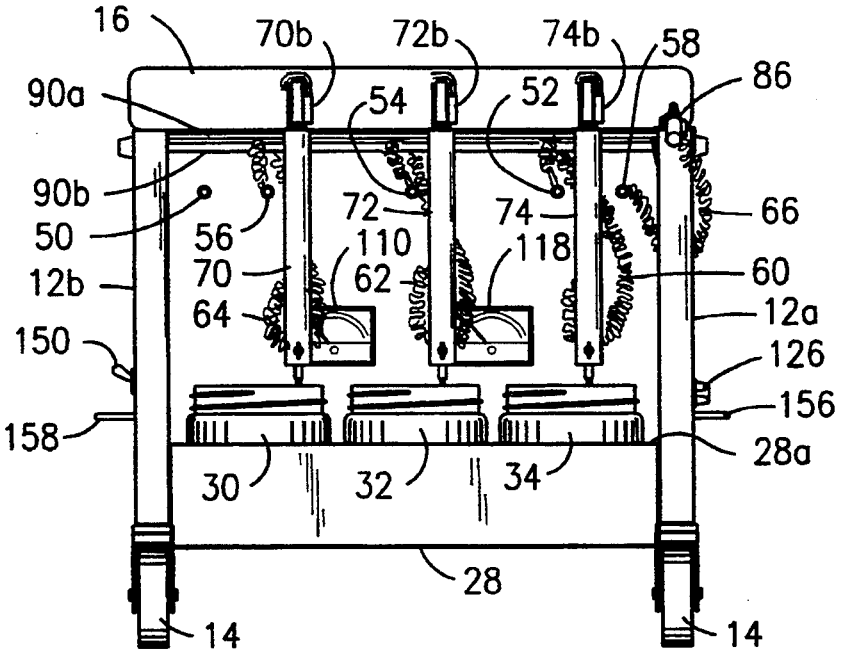
FIG. 3 is a front view in elevation of said embodiment.

When the power from the A.C. source is turned on by means of a switch 150, the readings on the D.C. volt meters 110 and 118 will be approximately 12 volts. These values are preset at the correct level for each step of the plating operation. The D.C. power source automatically adjusts the output voltages if it senses too much current is being drawn through the wands, thus preventing any damage to the workpiece. Bumpers 156 and 158 desirably are provided on the side walls of the D.C. power source 20 to protect the knob 126 and the switch 150, respectively, from possible damage due to careless handling of the unit 10, as shown in FIGS. 2 and 3.

In utilizing the unit 10 to electroplate gold on chrome plated emblems of an automobile, for example, a user first pours a sufficient amount of the required chemical solutions into the containers 30, 32, and 34. For gold plating, approximately a 10% solution of sodium hydroxide is poured into the container 30 for stripping the chrome down to the nickel base of the emblem. An approximately 5% solution of sulfuric acid is poured into the container 32. The acid solution activates the nickel base for receiving the gold plating to be applied to the emblem. The container 34 is supplied with a metal ion activated solution of a gold salt such as potassium aurocyanide. The user then assumes a sitting position on the seat 16 with his or her legs straddling the chemical solution tray 28.

Each of the wands 70, 72, and 74, as stated, is provided with a metal anode 80, 82, and 84, desirably made of stainless steel. The anodes advantageously are rounded to prevent scratching the workpiece in the event the tips of the anodes, for some reason, become exposed through the sleeves. To facilitate successive application of the solutions on the workpiece, each of the anodes advantageously is provided with an absorbent sleeve 160 formed of cotton or other absorbent fabric, and stitched along one end to prevent the metal anode from coming into contact with the workpiece. The sleeve 160 on the anode 80 of the wand 70 is first dipped into the base solution in the container 30, and the chemical solution saturated sleeve is brought into contact with the workpiece. During this step, as well as each of the succeeding steps, the alligator clip 86 is maintained in touch-contact with the workpiece. After the chrome layer has been removed with the base solution, the wand 70 is hung on the front rod 90a of the rack 90. The chrome free surface is rinsed with water to remove any residual base solution. A drip pan (not shown) desirably is used to intercept any fluid run-off from the workpiece. The user then takes the wand 72, and dips the absorbent sleeve carried on the anode 82 thereof into the acid solution in the container 32. The acid solution retained on the sleeve is then brought into contact with the surface of the workpiece and performs the activation step. As before, the wand 72 is hung on the rod **90*a* of the rack 90, and the acid treated solution is rinsed away. The third, and final step involves dipping the absorbent sleeve on the anode 84 of the wand 74 into the gold salt solution in the container 34. The sleeve with the gold solution absorbed therein is then brought into contact with the workpiece until a gold film of the desired thickness is attained. The rate of deposition of the gold on the workpiece can be controlled by the intensity adjustment knob 126. The knob 126 only affects the gold plating wand 74**, and is adjusted to control the rate at which the gold is deposited during the plating procedure.

Figure 9:
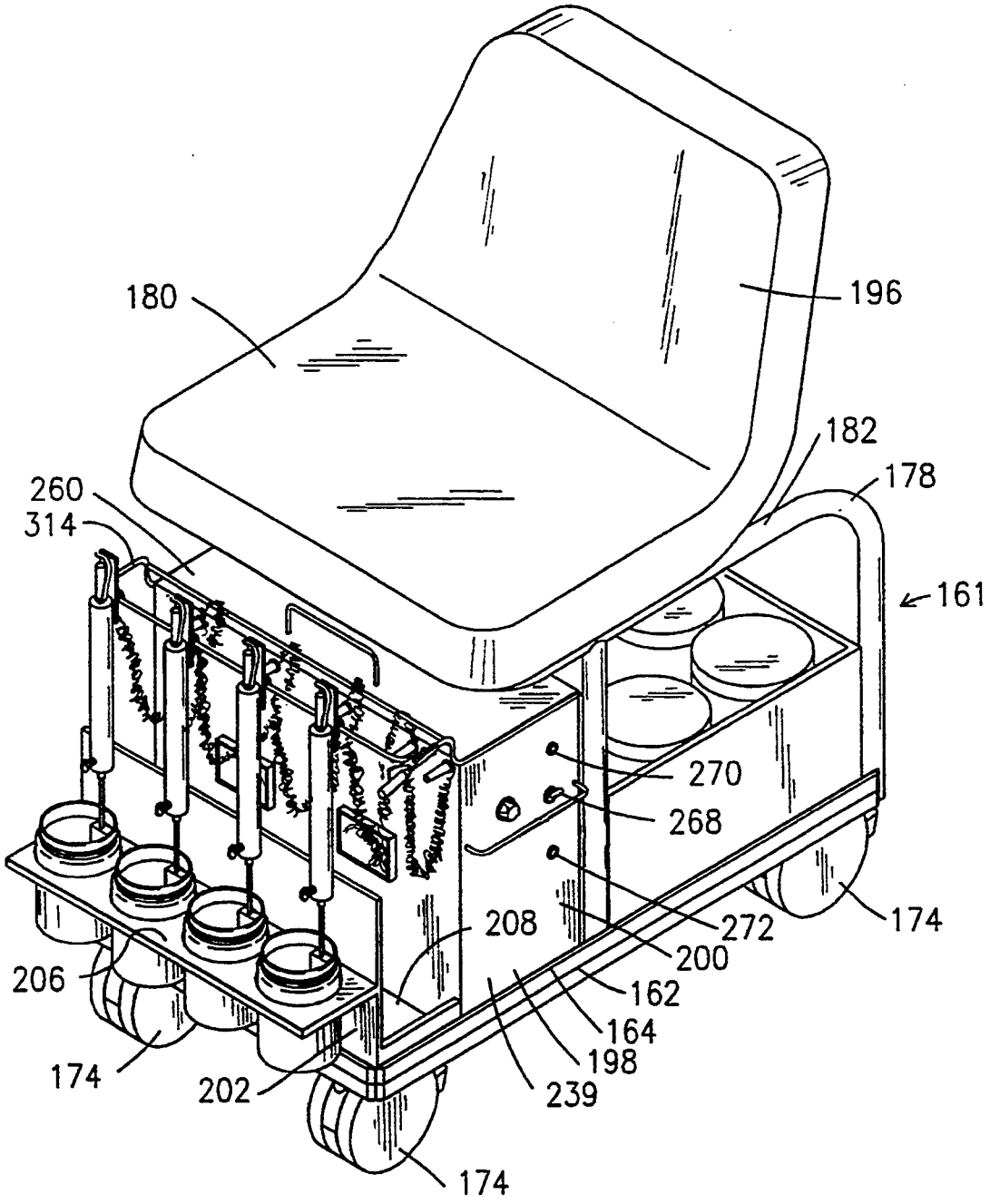
FIG. 9 is a view in perspective of the preferred embodiment of the electroplating unit of the present invention.
Figure 10:
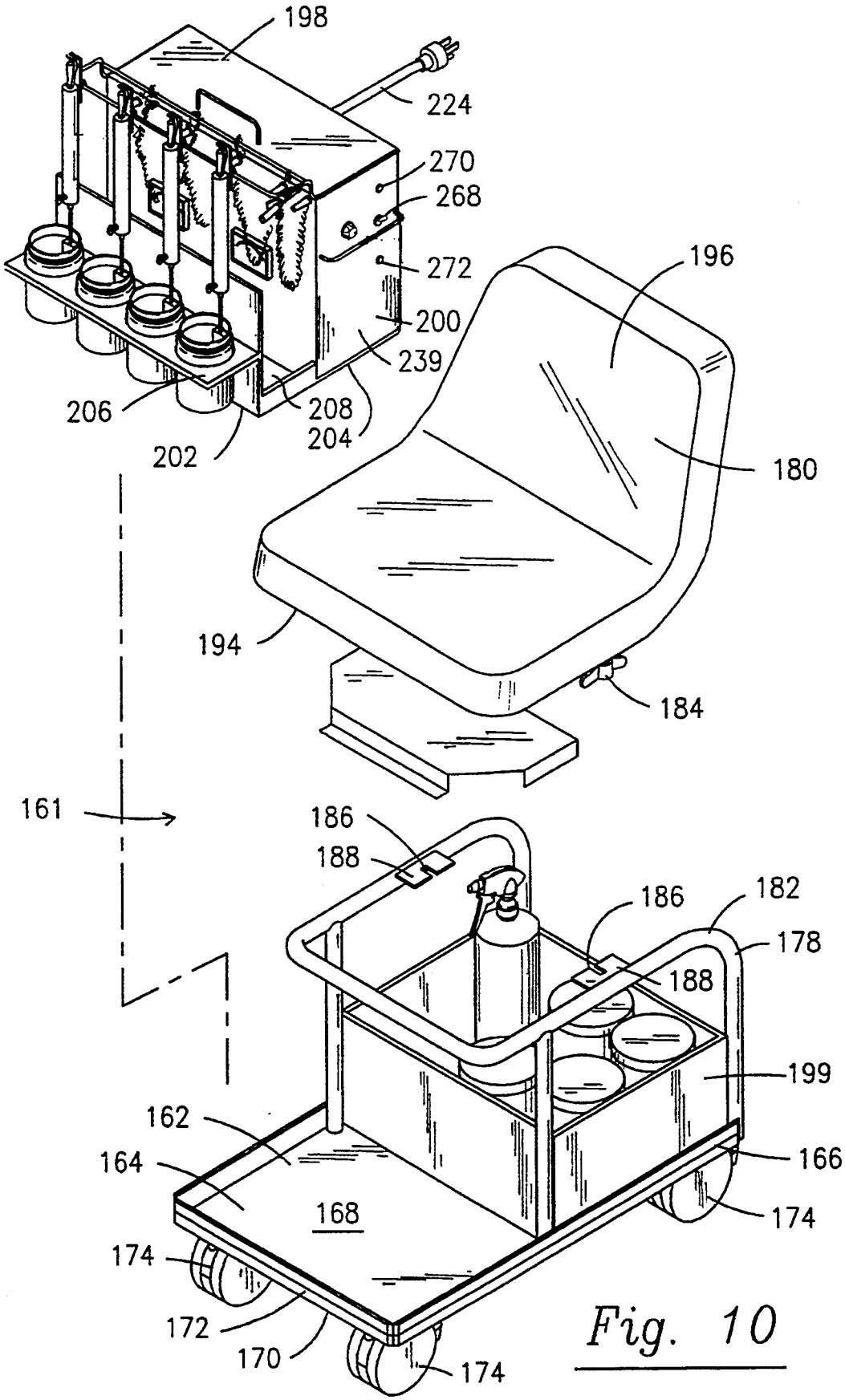
FIG. 10 is a view in perspective of the preferred embodiment illustrating the removable power source.
Figure 12:
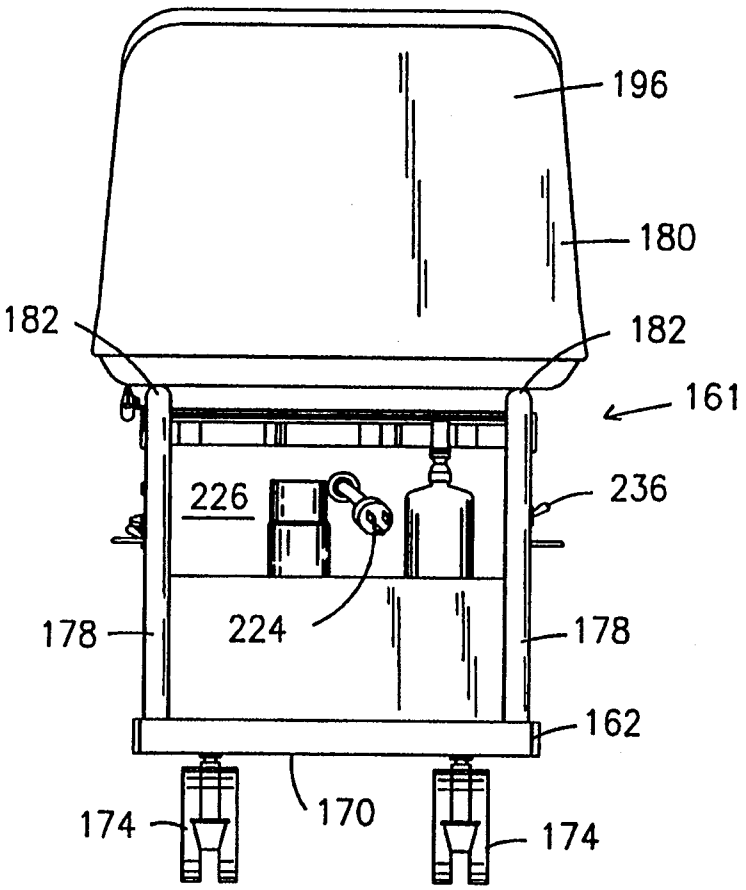
FIG. 12 is a rear view in elevation of the preferred embodiment.
Figure 11:
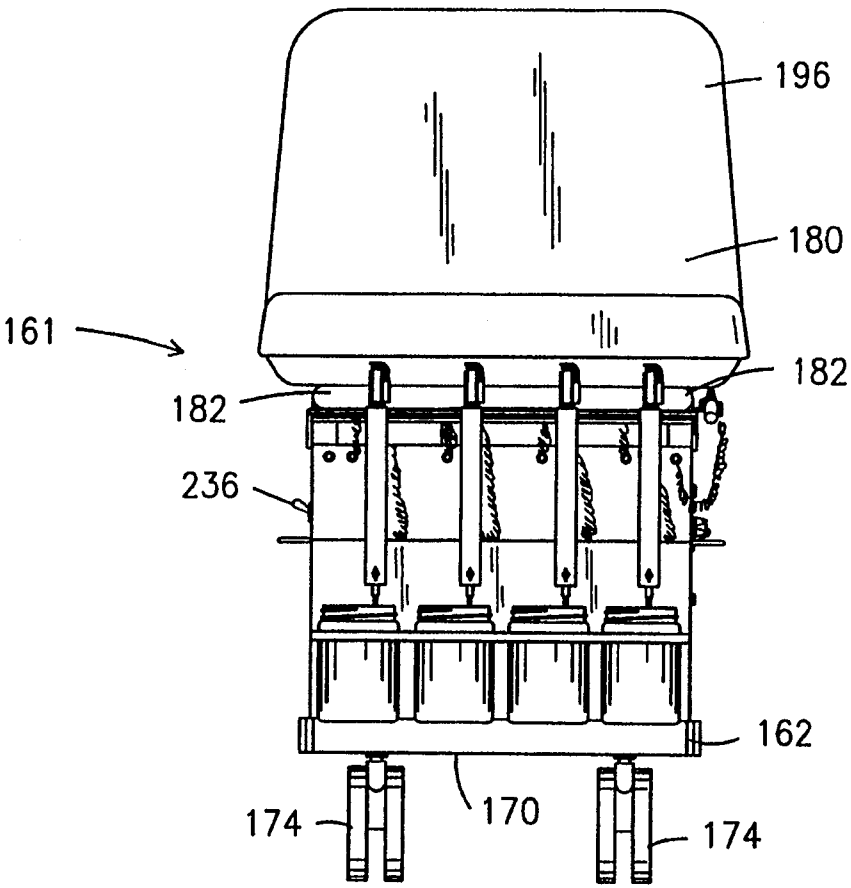
FIG. 11 is a front view in elevation of the preferred embodiment.
Figure 13:
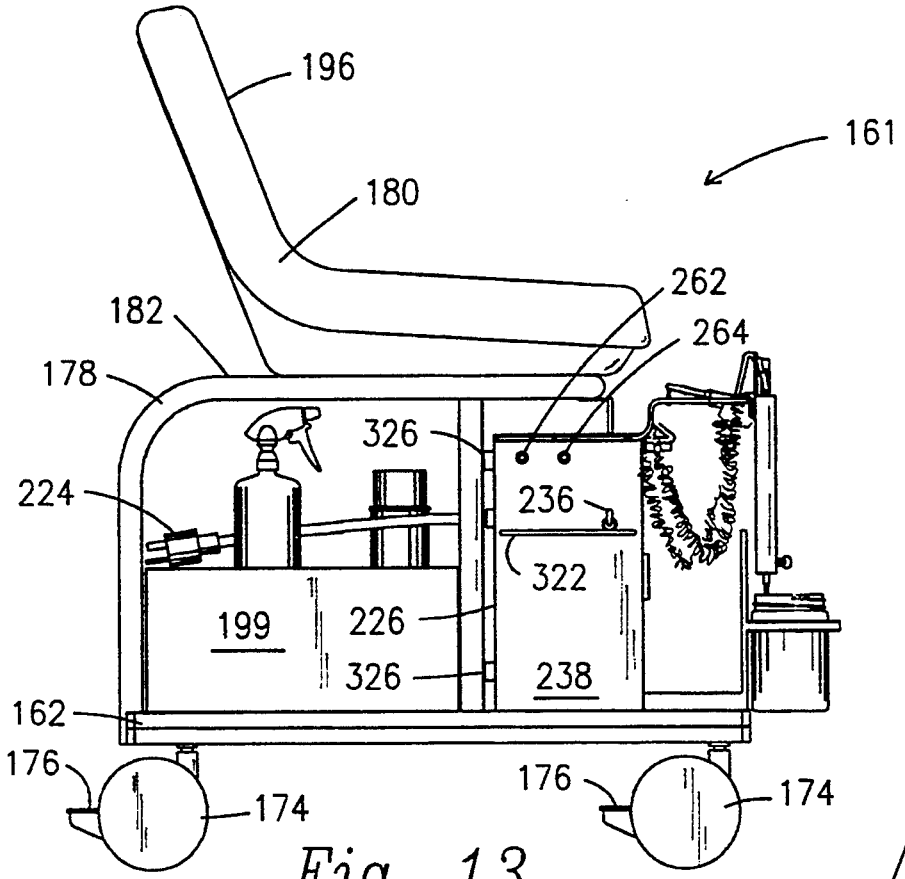
FIG. 13 is a right side view in elevation of the preferred embodiment.
Figure 14:
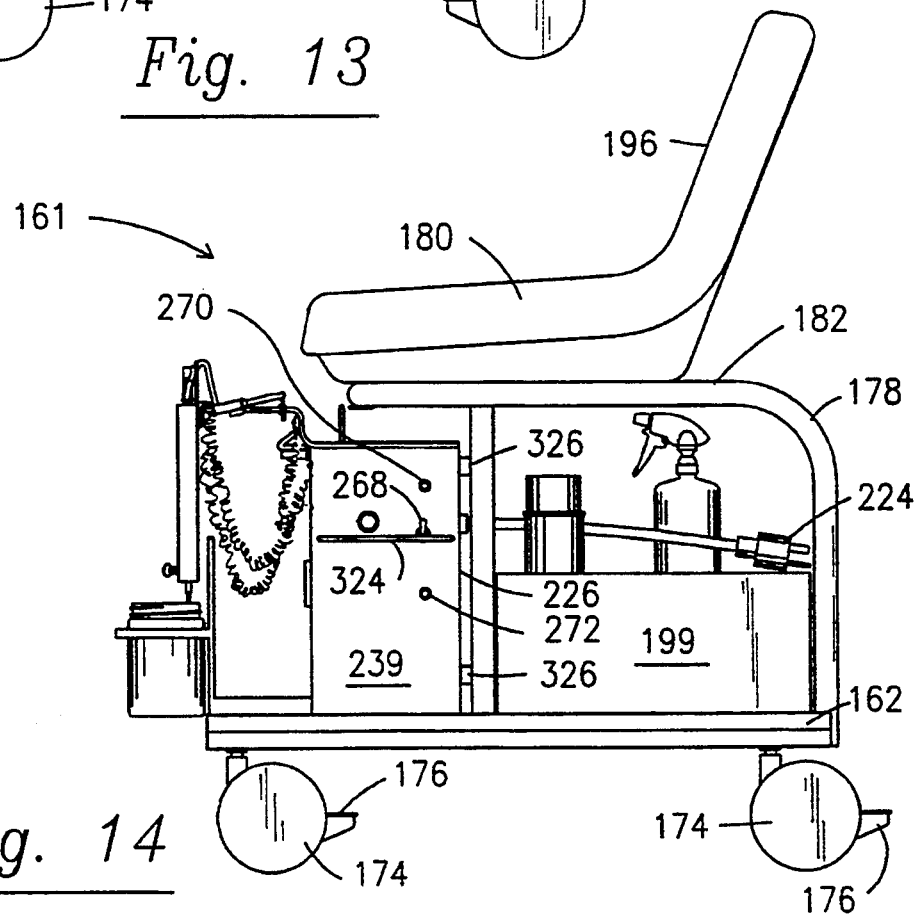
FIG. 14 is a left side view in elevation of the preferred embodiment.

Referring to FIGS. 9-14, a preferred embodiment of the mobile electroplating unit 161 is provided. Referring to FIG. 10, unit 161 has a support member 162 having front and rear portions 164 and 166 respectively, top and bottom surfaces 168 and 170 respectively, and an upwardly extending side wall 172 surrounding an outer circumference of support member 162. Two pair of wheels 174 are mounted along bottom surface 170 of support member 162, as shown in FIGS. 11 and 12, providing 360 degree rotation to unit 161. In the preferred embodiment, wheels 174 are provided with a locking mechanism 176, as shown in FIGS. 13 and 14. Locking mechanism 176 prohibits wheels 174 from moving, thereby providing a stable unit 161 from which an operator can work.

Referring to FIG. 10, unit 161 further has a seat support frame 178 mounted to top surface 168 of support member 162 generally located at rear portion 166 for supporting a removable seat 180. In the preferred embodiment, seat support frame 178 is welded to support member 162, although seat support frame 178 could be bolted to support member 162 to achieve the same result. Seat 180 removeably mounts to a top portion 182 of seat support frame 178 by a pair of wing nuts 184, mounted along bottom surface 194 of seat 180, respectively engaging a pair of channels 186 formed in a pair of alignment plates 188 mounted along seat support frame 178 proximal to top portion 182. In the preferred embodiment, alignment plates 188 are welded to seat support frame 178, paralleling top surface 168 of support member 162. A seat alignment member 190 mounted by bolts (not shown) along a bottom surface 194 of seat 180 facilitates the alignment of seat 180 along top portion 182 of seat support frame 178. Seat 180 has a high-back portion 196, as shown in FIGS. 9-14, providing support to the back of an operator.

Referring to FIGS. 9 and 10, a removable DC power source 198 is provided, wherein FIG. 10 illustrates DC power source 198 in a removed state from unit 161. DC power source 198 is generally located in front portion 164 of support member 162, as shown in FIG. 9, when replaced within unit 161. Removable DC power source 198 permits unit 161 to be used in bench or table top electro-plating processes, as well as providing greater ease to maintaining and cleaning all components of unit 161. Uses for removable DC power source 198 for bench or table top processes include electro-plating within the confined areas of houses, boats, and airplanes.

Figure 15:
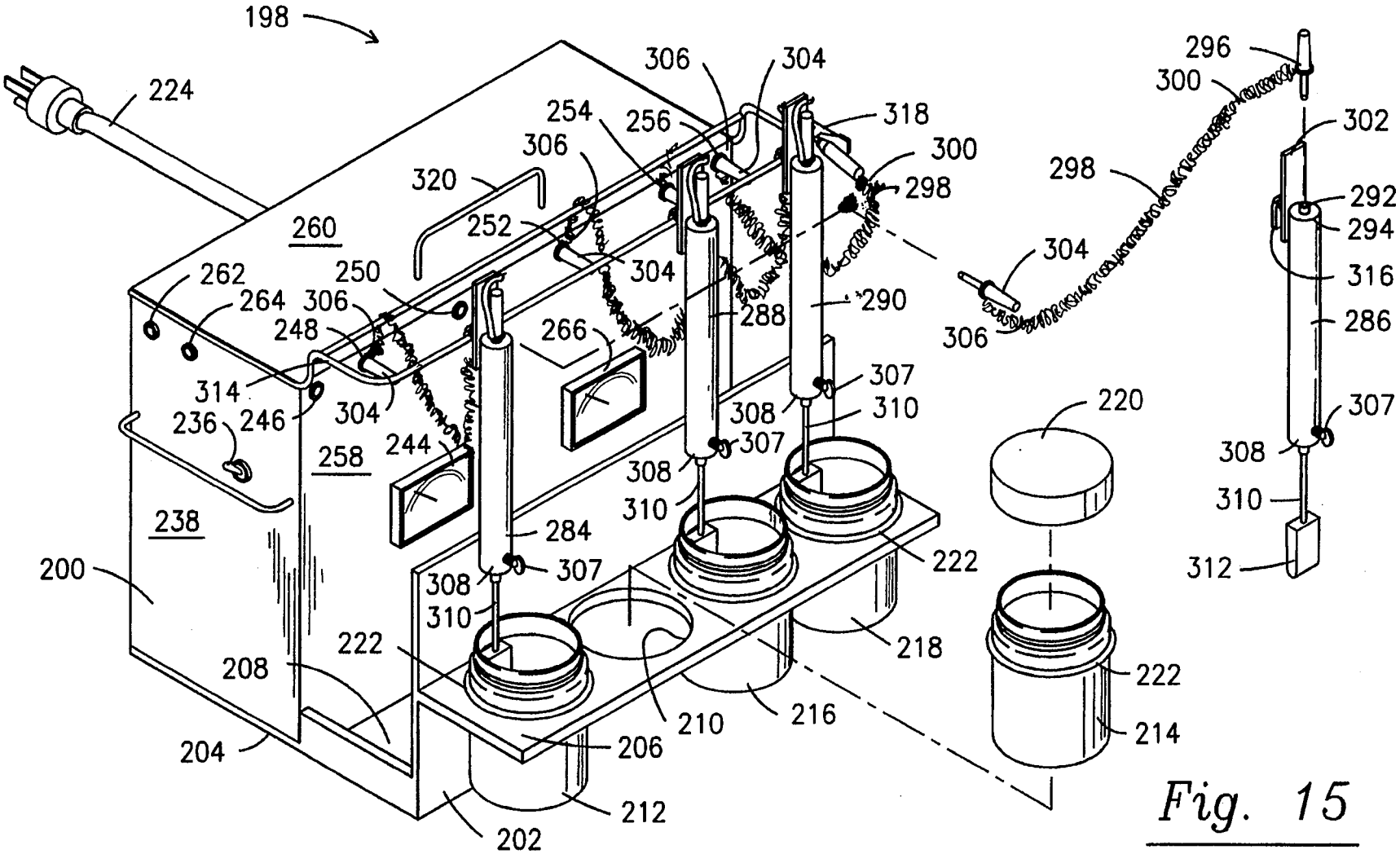
FIG. 15 is a partially exploded view of the D.C. power source used in the preferred embodiment.
Figure 16:
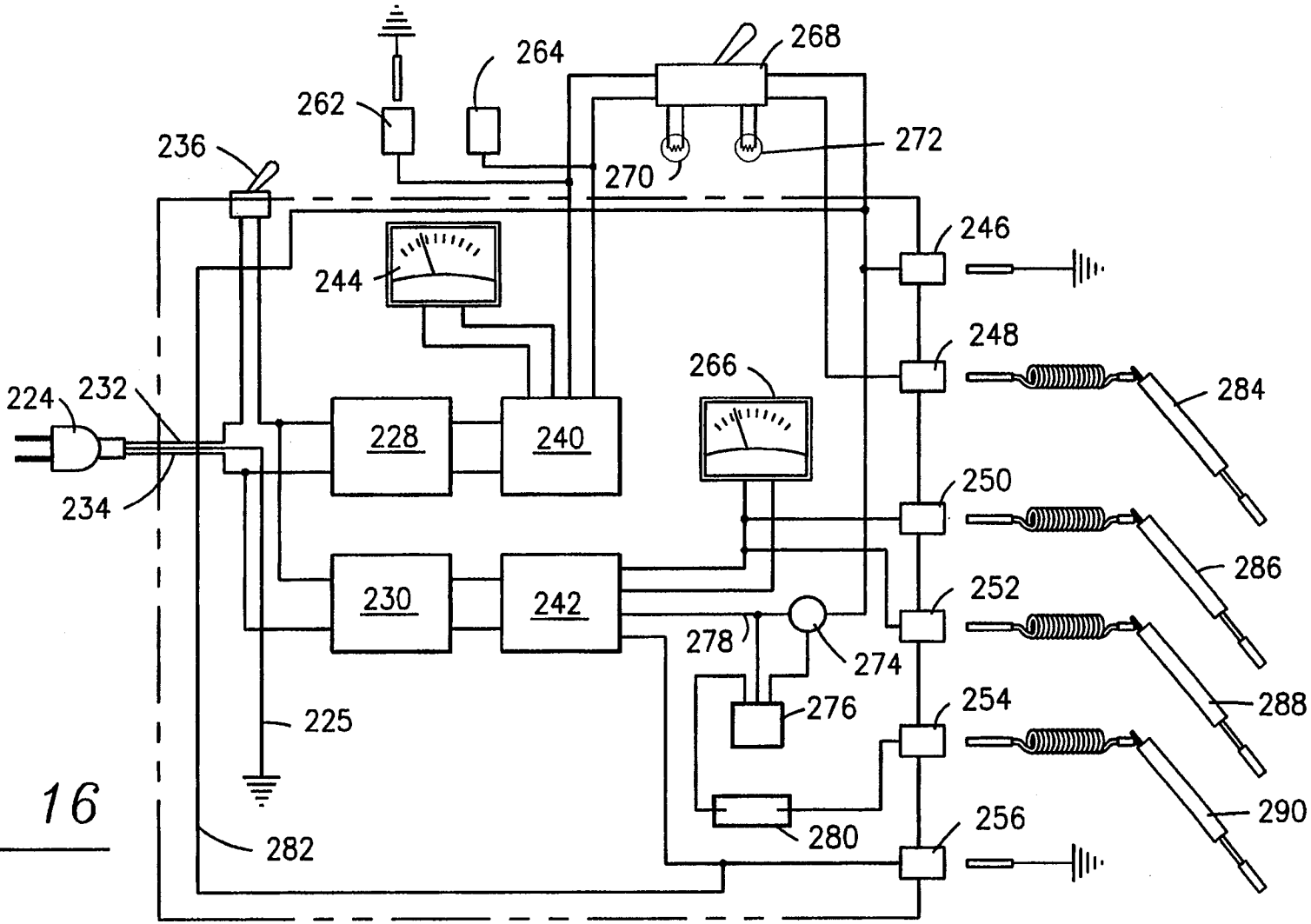
FIG. 16 is a schematic circuit diagram of the D.C. power source of the type incorporated in the preferred embodiment of the present invention.

Referring to FIG. 15, DC power source 198 has a housing 200 enclosing electronic components necessary for completing an electro-plating process upon a workpiece with unit 161. FIG. 16 illustrates the electronic circuit employed with unit 161 enclosed within housing 200. In the preferred embodiment, housing 200 is generally rectangular in shape and made of stainless steel. A retaining tray 202 is secured to housing 200 along a lower portion 204 of housing 200 by a plurality of bolts (not shown). Tray 202 has a shelf 206 outwardly projecting from housing 200 and a retainment area 208 located intermediate shelf 206 and housing 200. Shelf 206 is positioned slightly above retainment area 208 in relation to lower portion 204 and has a plurality of apertures 210 formed therein for supporting a plurality of containers in a stable, spaced relation to one another. In the preferred embodiment, shelf 206 has four apertures 210 formed therein for supporting containers 212, 214, 216, and 218 respectively. Containers 212, 214, 216, and 218 hold chemicals associated with the electro-plating process, each container having a lid 220 for enclosing its respective chemical solution and a lip 222 located along the outer circumference proximal to lid 220 permitting a friction fit of containers 212, 214, 216, and 218 within apertures 210. In the preferred embodiment, tray 202 is made of a high impact acrylic.

Referring to FIG. 10, a removable storage bin 199 is provided for retaining and storing chemicals, tools, and other items relative to performing an electro-plating process. Bin 199 rests upon top surface 168 of support member 162 generally in rear portion 166. In the preferred embodiment, bin 199 is made of a high impact acrylic.

Referring to FIG. 15, six voltage output receptacles 246, 248, 250, 252,254, and 256 are provided along a front wall 258 of housing 200 proximal to a top wall 260 of housing 200. Two additional voltage output receptacles 262 and 264 are provided along a right side wall 238 of housing 200. In the preferred embodiment, voltage output receptacles 246,248, 250, 252, 254, 256, 262, and 264 are banana type jacks. The potential difference at voltage output receptacles 246, 248, 250, 252, 254, 256, 262, and 264 is 12 volts.

Referring to FIG. 16, a schematic circuit diagram is provided, illustrating the electronic components employed with unit 161. An AC power plug 224 is located along a back wall 226 of housing 200, as shown in FIG. 12, thereby providing alternating current to unit 161. A lead 225 from plug 224 is attached to housing 200, thereby providing a reference to ground for the alternating current. A pair of transformers 228 and 230 are connected to power plug 224 by a pair of leads 232 and 234, wherein lead 232 has a power switch 236 inserted along lead 232 providing an "on and off" state for unit 161. Switch 236 is accessible to an operator along right side wall 238 of housing 200 of DC power source 198, as shown in FIG. 15. A pair of full wave rectifiers 240 and 242, in the form of circuit boards, are directly connected to transformers 228 and 230 respectively. Rectifiers 240 and 242 contain a filter (not shown) and a regulator (not shown) for inhibiting an over abundance of current being drawn from unit 161 and for providing regulated DC current to unit 161. Rectifier 240 is directly connected to a DC voltmeter 244 and rectifier 242 is directly connected to a DC voltmeter 266. DC voltmeters 244 and 266 provide an "on" indication for unit 161, as well as providing an indication whether too much current is being drawn from unit 161.

Referring to FIG. 16, rectifier 240 is directly connected to voltage output receptacles 262 and 264. Additionally, rectifier 240 is connected to output receptacles 246 and 248 and has a polarity switch 268 coupled intermediate rectifier 240 and output receptacles 246 and 248. Polarity switch 268 has a pair of indicator lights 270 and 272 coupled therewith, wherein the preferred embodiment employs tungsten filament lights of yellow and green respectively. LED's could be employed for indicator lights 270 and 272 to achieve the same result. Polarity switch 268 provides a means for reversing the respective polarities of output receptacles 246 and 248. To strip chrome, output receptacle 248 requires a negative polarity while output receptacle 246 requires a positive polarity. Accordingly, polarity switch 268 is positioned such that indicator light 270 illuminates yellow and indicator light 272 does not illuminate. To electro-clean copper, brass, silver, or stainless steel, output receptacle 248 requires a positive polarity while output receptacle 246 requires a negative polarity. Accordingly, polarity switch 268 is positioned such that indicator light 272 illuminates green and indicator light 270 does not illuminate. Use of output receptacle 256 can be substituted for output receptacle 246 to perform a stripping or electro-cleaning process and the polarity of output receptacle 256 is accordingly affected in the same manner as output receptacle 246 due to a lead 282 connecting output receptacle 256 to output receptacle 246. As shown in FIG. 16, output receptacles 262 and 264 are not affected by polarity switch 268; accordingly, output receptacle 264 always has a negative polarity while output receptacle 262 always has a positive polarity. Polarity switch 268 and indicator lights 270 and 272 are provided along a left side wall 239 of housing 200, as shown in FIGS. 9 and 14. The polarity of output receptacles 250, 252, and 254 is always positive and is not affected by polarity switch 268. Further, if a process is being completed using output receptacles 250, 252, or 254, then the polarity of output receptacles 246 and 256 is always negative and not affected by the relative position of polarity switch 268. The reference to ground and the associated negative polarity at output receptacles 246 and 256 is always being drawn from transformer 230 and rectifier 242 during a process utilizing output receptacles 250, 252, or 254.

Referring to FIG. 16, rectifier 242 is directly connected to a potentiometer 274 and to a collector lead of a transistor 276 by a lead 278. An emmitor output of transistor 276 is directly connected to a resistor 280. Resistor 280 is directly connected to output receptacle 254. Potentiometer 274 is directly connected to output receptacle 246 and to output receptacle 256 by lead 282. A base lead of transistor 276 is directly connected to potentiometer 274. In the preferred embodiment, potentiometer 274 is a linear potentiometer having a resistive value of 500 ohms, transistor 276 is an NTE 214, and resistor 280 has a resistive value of 6.8 ohms and power rating of 25 watts. Components of other values can be substituted for the ones provided herewith to achieve the same results in the same manner. A knob located along left side wall 239, as shown in FIGS. 9, 10, and 14, allows an operator to manipulate potentiometer 274.

Potentiometer 274 only affects output receptacle 254, 256 and 246. As potentiometer 274 decreases its resistance, the emmitor output of transistor 276 increases. Potentiometer 274 sets up a bias voltage on transistor 276 thereby controlling the current flowing through the emmittor output of transistor 276. Resistor 280 is a current limiting resistor, thereby prohibiting too much current from being drawn from output receptacle 254.

Referring to FIG. 15, four hand manipulated applicators or wands 284, 286, 288, and 290 are provided. Wands 284, 286, 288, and 290 are in the shape of elongated cylinders having a jack 292 at a top end 294 adapted for receiving a first connector 296. First connector 296 is a banana type plug connected to a cable 298. Cable 298 is a two lead braided cable wrapped at a first end 300 around a cable relief member 302 attached at top end 294 of each wand. A plurality of plastic ties (not shown) assist cable 298 to retain its braided configuration. A second connector 304 is connected to a second end 306 of cable 298. Second connector 304 is also a banana type plug. Wands 284, 286, 288, and 290 are connected to output receptacles 248, 250, 252, and 254 respectively by inserting second connector 304 into the respective output receptacle. Wands 284, 286, 288, and 290 are provided with a thumb screw 307 located at a bottom end 308 of wands 284, 286, 288, 290 for retaining a metallic anode 310. Anode 310 is provided with an absorbent sleeve 312 at a tip portion of anode 310 located distal from thumb screw 307. Sleeve 312 is made of cotton or other absorbent material and prevents metal anode 310 from coming in contact with a workpiece.

Referring to FIG. 9, a wand and cable supporting rack 314 is mounted to housing 200 at a position slightly below seat 180 but slightly above and in front of top wall 260 of housing 200. In the preferred embodiment, rack 314 is welded along an outer edge of top wall 260 of housing 200, as shown in FIG. 15. Rack 314 extends outwardly from housing 200 such that a hook 316 mounted by bolts (not shown) to top end 294 of wands 284, 286, 288, and 290 permits wands 284, 286, 288, and 290 to be supported above containers 212, 214, 216, and 218 respectively, as shown in FIG. 15. When hook 316 is engaging rack 314, anode 310 of wands 284, 286, 288, and 290 are partially submerged within containers 212, 214, 216, and 218 respectively, as shown in FIG. 15. Rack 314 additionally allows cable 298 of each wand to be wrapped about rack 314 providing strain relief to cable 298.

Referring to FIG. 15, a clip 318 connected to cable 298 at a first end 300 of cable 298 is provided. Second connector 304, in the form of a banana type plug, is connected to second end 306 of cable 298 for insertion into output receptacle 246, 256, or 262. Clip 318 is in the form of an alligator clip and acts as a cathode or anode during an electro-plating operation, and serves to complete an electric circuit between the workpiece and DC power source 198. Output receptacles 246, 256, and 262 additionally provide a reference to ground during an electro-plating process. Depending on operator preference or the dominant hand of an operator, clip 318 and its associated second connector 304 is inserted into either output receptacle 246 or 256. Output Receptacle 262 is primarily used for alternate stripping or electrocleaning while working on a workpiece with output receptacles 246, 248, 250, 252, 254, and 256. Clip 318 is secured to a plastic tie (not shown) attached to rack 314 when clip 318 is not being used.

Referring to FIG. 15, housing 200 has a top handle 320 mounted along top wall 260 of housing 200. A right side handle 322 (see FIG. 13) and a left side handle 324 (see FIG. 14) are mounted along right and left side walls 238 and 239 respectively. Right and left handles 322 and 324 provide a means for removing, lifting, and transporting DC power source 198, as well as a means to protect the respective switches and knobs provided along right and left side walls 238 and 239. As shown in FIGS. 13 and 14, a plurality of rubber feet 326 are mounted along back wall 226 of housing 200 to prohibit housing 200 of coming in contact with seat support frame 178. In the preferred embodiment, there are four rubber feet 326 mounted by bolts (not shown) along back wall 226 at the four opposed corners.

In utilizing the present invention to gold plate a workpiece, unit 161 is positioned proximal to the workpiece to be gold plated. AC plug 224 is inserted into a standard electrical outlet (not shown), and power switch 236 is switched to its "on" position. DC voltmeters 244 and 266 confirm that unit 161 is "on" by displaying 12 volt DC. A solution of approximately 10% sodium hydroxide is poured into container 212 for stripping chrome down to a nickel base on the workpiece. A solution of approximately 5% sulfuric acid is poured into container 214 for activating the nickel base for receiving the gold plating to be applied. A solution of nickel complex is poured into container 216 for applying a nickel base to the workpiece if the workpiece does not have one. A metal ion activated solution of a gold salt such as potassium aurocyanide is supplied to container 218 for applying the gold plating to the workpiece.

The operator assumes a sitting position on seat 180 of unit 161 with their legs straddling the containers. Sleeve 312 of wand 284 is submerged into the solution in container 212 and thereafter applied to the workpiece while clip 318 closes the circuit by coming in contact with the workpiece. A drip pan (not shown) is desirably positioned underneath the workpiece to catch any spilling or running of the solutions being applied to the workpiece. After the chrome has been successfully stripped away, water is sprayed by a spray bottle to remove any excess solution. Next, sleeve 312 of wand 286 is submerged into container 214 and thereafter applied to the workpiece while clip 318 closes the circuit by coming in contact with the workpiece. Again water is sprayed on the workpiece to remove any excess solution. If a nickel base is present, sleeve 312 of wand 290 is submerged into container 218 and thereafter applied to the workpiece while clip 318 closes the circuit by coming in contact with the workpiece. Potentiometer 274 is adjusted accordingly to apply the desired thickness of gold upon the workpiece. The workpiece is then polished using any known commercial glass of gold polish. If a nickel base is not present on the workpiece, sleeve 312 of wand 288 is submerged in container 216 and thereafter applied to the workpiece while clip 318 closes the circuit by coming in contact with the workpiece before the gold is applied using wand 290.

In the preferred embodiment, wands 284, 286, 288, and 290 have a conductive metal center utilizing stainless steel surrounded by a polymer casing. Support member 162, seat support frame 178, alignment plates 188, alignment member 190, housing 200, rack 314, top handle 320, and right and left side handles 322 and 324 are made of stainless steel. Anode 310 is made of stainless steel although graphite or platinum could be used.

It will be apparent to those skilled in the art that various changes in form and detail of the invention as shown and described may be made. It is intended that any such changes be included within the spirit and scope of the claims appended hereto.

Having thus described the invention what is claimed and desired to be secured by Letters Patent is:

1. A portable apparatus for plating a metal surface comprising, a support member, a seat mounted to the support member enabling an operator to assume a sitting position upon the apparatus to plate the metal surface, a DC power source carried upon the support member, means for sequentially applying chemical solutions to the metal surface to be plated, electrically coupled to the DC power source, and means for completing an electrical circuit from the DC power source to the metal surface to be plated, electrically coupled to the DC power source.

2. The portable apparatus for plating a metal surface according to claim 1 further comprising, means for moving the apparatus to any desired position during a metal plating process.

3. The portable apparatus for plating a metal surface according to claim 2, wherein the means for moving the apparatus to any desired position during a metal-plating process is a plurality of wheels attached to the support member, the wheels permitting 360 degree rotation of the apparatus.

4. The portable apparatus for plating a metal surface according to claim 3, wherein four wheels are provided, the four wheels mounted by bolts to a bottom surface of the support member.

5. The portable apparatus for plating a metal surface according to claim 1, wherein the DC power source is removable from the support member.

6. The portable apparatus for plating a metal surface according to claim 1, wherein the means for sequentially applying chemical solutions to the metal surface to be plated is a plurality of hand manipulated applicators, each applicator adapted to apply a different chemical solution to the metal surface to be plated and adapted to permit electrical current to pass therethrough to the metal surface to be plated, each applicator removably connected to an electrical conduit, and each conduit adapted to be removably connected to the DC power source.

7. The portable apparatus for plating a metal surface according to claim 6, wherein four hand manipulated applicators are provided.

8. The portable apparatus for plating a metal surface according to claim 1, wherein the means for completing an electrical circuit from the DC power source to the metal surface to be plated is a conductive terminal, the conductive terminal coupled to an electrical conduit, the conduit removably connected to the DC power source.

9. A portable apparatus for plating a metal surface comprising, a support member having a top and bottom surface, a seat support frame having a top portion, the seat support frame attached to the top surface of the support member, a removable seat mountable to the top portion of the seat support frame, the seat enabling an operator to assume a sitting position upon the apparatus to plate the metal surface, a removable DC power source having a plurality of voltage output receptacles, the DC power source carried upon the top surface of the support member, means for moving the apparatus to any desired position during a metal plating process, means for sequentially applying chemical solutions to the metal surface to be plated, electrically coupled to the DC power source, and means for completing an electrical circuit from the DC power source to the metal surface to be plated, electrically coupled to the DC power source.

10. The portable apparatus for plating a metal surface according to claim 9 further comprising, means for retaining a plurality of chemical solution containers, mounted on the DC power source.

11. The portable apparatus for plating a metal surface according to claim 10, wherein the means for retaining a plurality of chemical solution containers is a tray mounted along a lower portion of the DC power source, the tray having a retainment area and a shelf extending outwardly relative to a front wall of the DC power source, the shelf positioned in front of and above the retainment area and having a plurality of apertures formed therein, the pularity of apertures frictionally retaining the plurality of chemical solution containers respectively.

12. The portable apparatus for plating a metal surface according to claim 11, wherein four apertures formed in the shelf of the tray frictionally retain four chemical solution containers respectively.

13. The portable apparatus for plating a metal surface according to claim 9, wherein the plurality of voltage output receptacles has a predetermined set voltage level.

14. The portable apparatus for plating a metal surface according to claim 9, wherein the means for moving the apparatus to any desired position during a metal plating process is a plurality of wheels attached to the support member, the wheels permitting 360 degree rotation of the apparatus.

15. The portable apparatus for plating a metal surface according to claim 14, wherein four wheels are provided, the four wheels mounted by bolts to the bottom surface of the support member.

16. The portable apparatus for plating a metal surface according to claim 9, wherein the means for sequentially applying chemical solutions to the metal surface to be plated is a plurality of hand manipulated applicators, each applicator adapted to apply a different chemical solution to the metal surface to be plated and adapted to permit electrical current to pass therethrough to the metal surface to be plated, each applicator removably connected to an electrical conduit, and each conduit adapted to be removably connected to the DC power source.

17. The portable apparatus for plating a metal surface according to claim 16, wherein four hand manipulated applicators are provided.

18. The portable apparatus for plating a metal surface according to claim 9, wherein the means for completing an electrical circuit from the DC power source to the metal surface to be plated is a conductive terminal, the conductive terminal coupled to an electrical conduit, the conduit adapted to be removably connected to the DC power source.

19. A portable apparatus for plating metal surfaces comprising, a support member having a top and bottom surface and a front and rear portion, a plurality of wheels mounted along the bottom surface of the support member, the wheels having engagable locking mechanisms for prohibiting the apparatus from moving, a removable DC power source carried upon the top surface of the support member in the front portion, the DC power source having a housing enclosing an electronic circuit, an AC plug located along a back wall of the housing coupled to the electronic circuit for connection with an alternating current source, a plurality of voltage output receptacles located along a front wall and right side wall of the housing, a plurality of handles mounted along a top and left and right side walls of the housing to permit the power source to be moved, and a retaining tray mounted along a lower portion of the housing, the retaining tray having a retainment area extending outwardly from a front wall of the housing and a shelf having a plurality of apertures formed therein, the shelf located slightly in front of and above the retainment area and extending outwardly from the front wall of the housing, the plurality of voltage output receptacles having a predetermined set voltage level, a seat support frame mounted to the top surface of the support member in the rear portion and having a pair of alignment plates mounted along a top portion of the seat support frame, the pair of alignment plates having a pair of channels formed therein, a removable seat having a high-back portion, an alignment member mounted along a bottom surface of the seat for engagement with the top portion of the seat support frame, and a pair of wings nuts mounted along the bottom surface of the seat for engagement with the pair of channels formed in the alignment plates, the wing nuts locking the removable seat to the seat support frame, a removable storage bin positioned along the top surface of the support member in the rear portion for retaining items used in a plating process, a plurality of hand manipulated cylindrical applicators electrically coupled to the DC power source, each applicator having a top and bottom end, a conductive center portion, a jack formed in the top end, a thumb screw located at the bottom end for retaining a conductive terminal, a sleeve surrounding a tip portion of the conductive terminal to protect the metal surface to be plated from the terminal and for applying a respective chemical solution to the metal surface to be plated, a first connector for insertion into one of the voltage output receptacles, a second connector for insertion into the jack in the top end of the applicator, and an electrical conduit connecting the first and second connector, the conductive terminal coupled to the conductive center portion of the applicator, the first connector of each applicator removably connectable with the voltage output receptacles, a conductive clip coupled to a second connector by an electrical conduit, the clip for contact with the metal surface to be plated to complete an electrical circuit, a plurality of containers frictionally retained within the apertures formed in the shelf, the containers holding chemical solutions necessary to complete the metal plating process, a plurality of cable strain relief members mounted at the top end of each applicator for relieving stress placed upon the conduit at a point proximal to the second connector, a rack attached to the housing for removably positioning the plurality of applicators above the plurality of containers in a spaced and stable relationship, and a hook mounted at the top end of each applicator for engagement with the rack.

20. The portable apparatus for plating a metal surface according to claim 19, wherein the electronic circuit has a first and second transformer, a first and second full wave rectifier, a current limiting resistor, a transistor, a potentiometer, a first and second DC voltmeter, an on/off switch, a polarity switch, a first and second indicator light, and a first, second, third, fourth, fifth, sixth, seventh, and eighth voltage output receptacle, the AC plug connected to the first and second transformer by a first and second lead and grounded to the housing by a third lead, the on/off switch coupled intermediate the AC plug and the first and second transformers along the first lead, the first and second transformers directly connected to the first and second full wave rectifiers respectively, the first and second full wave rectifiers having a filter and regulator for inhibiting an over abundance of current being drawn from the apparatus and for providing regulated DC current to the apparatus, the first and second full wave rectifiers directly connected to the first and second DC voltmeters respectively, the first full wave rectifier connected to the first, second, sixth, seventh, and eighth voltage output receptacles, the polarity switch coupled intermediate the first full wave rectifier and the first, second, and sixth voltage output receptacles, the second full wave rectifier connected to the first, third, fourth, fifth, and sixth voltage output receptacles, the second full wave rectifier directly connected to the potentiometer by a fourth lead and to the transistor through a collector lead of the transistor coupled along the fourth lead, a base lead of the transistor directly connected to the potentiometer, an emmitor output of the transistor directly connected to the resistor, the resistor directly connected to the fifth voltage output receptacle, the potentiometer directly connected to the first and sixth voltage output receptacles and adjustable by a knob communicating with the potentiometer located along the left side wall of the housing, the polarity switch permitting a respective polarity at the first and second or sixth and second voltage output receptacles to be inverted, the polarity switch and first and second indicator lights located along the left side wall of the housing, the on/off switch located along the right side wall of the housing, the seventh and eighth output receptacles located along the right side wall of the housing, the first, second, third, fourth, fifth, and sixth output receptacles located along the front wall of the housing, and the first and second DC voltmeters located along the front wall of the housing.

* * * * *